US006634256B2

(12) United States Patent
Weissenborn

(10) Patent No.: US 6,634,256 B2
(45) Date of Patent: Oct. 21, 2003

(54) APPARATUS FOR SHARPENING/ BEVELLING OF SKI AND SNOWBOARD EDGES INCORPORATING A VARIABLE ANGLE ADJUSTMENT AND CLAMPING MECHANISM

(76) Inventor: Richard K. Weissenborn, 3017 6th St. Street S.W., Calgary, Alberta (CA), T2S 2M1

( * ) Notice: Subject to any disclaimer, the term of this patent is extended or adjusted under 35 U.S.C. 154(b) by 0 days.

(21) Appl. No.: 09/933,227

(22) Filed: Aug. 20, 2001

(65) Prior Publication Data

US 2002/0035894 A1 Mar. 28, 2002

Related U.S. Application Data

(63) Continuation-in-part of application No. 09/403,079, filed as application No. PCT/CA98/00320 on Apr. 9, 1998, now Pat. No. 6,386,068.

(30) Foreign Application Priority Data

Aug. 21, 2000 (CA) ..... 2316559

(51) Int. Cl.[7] ..... A63C 11/06
(52) U.S. Cl. ..... 76/83; 76/88
(58) Field of Search ..... 76/82, 83, 88; 451/552, 555, 558; 407/29.15

(56) References Cited

U.S. PATENT DOCUMENTS

| | | | | |
|---|---|---|---|---|
| 3,914,839 A | | 10/1975 | Holdsworth | |
| 4,030,382 A | | 6/1977 | Nilsson et al. | |
| 4,060,013 A | | 11/1977 | Thompson | |
| 4,601,220 A | | 7/1986 | Yurick et al. | |
| 4,663,993 A | | 5/1987 | Weninger et al. | |
| 4,721,020 A | | 1/1988 | Stumpf | |
| 4,850,252 A | | 7/1989 | Sewell | |
| 5,485,768 A | | 1/1996 | Vermillion | |
| 5,701,787 A | | 12/1997 | Brill | |
| 6,386,068 B1 | * | 5/2002 | Weissenborn | 76/83 |

FOREIGN PATENT DOCUMENTS

| | | |
|---|---|---|
| CH | 656 545 | 12/1978 |
| DE | 3233682 A1 | 9/1982 |
| DE | 3313367 A1 | 4/1983 |
| DE | 295 01 920.4 | 2/1995 |
| WO | WO/8503008 | 7/1985 |

* cited by examiner

*Primary Examiner*—Hwei-Siu Payer
(74) *Attorney, Agent, or Firm*—Stevens & Showalter, LLP

(57) ABSTRACT

Apparatus for the sharpening and/or bevelling of either a ski or snowboard side edge or base edge includes a guide for clamping a file therein and adapted to be held by a hand of a person using the guide and moved lengthwise along an edge portion of a ski or snowboard while in contact with a surface thereof. A variable angle adjustment mechanism establishes an almost unlimited number of selected angular orientations of the guide and the file in a plane transverse to the lengthwise direction when positioned at the side or base edge portion of the ski or snowboard while in contact with the surface thereof. The variable angle adjustment mechanism is integrated with a file clamping mechanism in the guide.

9 Claims, 11 Drawing Sheets

APPARATUS FOR SHARPENING/ BEVELLING OF SKI AND SNOWBOARD EDGES INCORPORATING A VARIABLE ANGLE ADJUSTMENT AND CLAMPING MECHANISM

CROSS-REFERENCE TO RELATED APPLICATION

This application is a continuation in part of my patent application Ser. No. 09/403,079 effectively filed Jul. 21, 2000, now U.S. Pat. No. 6,386,068, which is a 371 of PCT/CT98/00320 filed Apr. 9, 1998.

BACKGROUND OF THE INVENTION

The present invention relates to improved apparatus for the sharpening and/or bevelling of either a ski or a snowboard side edge or base edge.

Apparatus of this nature typically includes a guide adapted to be held by a hand of a person using the guide and moved lengthwise along an edge portion of a ski or snowboard while in contact with a surface thereof. Such apparatus also includes a clamping mechanism for clamping a file or the like (e.g. commercially available cutting and polishing implements such as mill files, diamond stones etc.) in or to the guide.

Until recently, both ski and snowboard designs incorporated metal edges with conventional 90 degree edge geometry (ski or snowboard base edge and base create a flat running surface with the side edge perpendicular to the base edge). Ski and snowboard designs have changed dramatically in the past few years as a result of technological advances in materials and construction. Ski and snowboard side cut and camber are now more pronounced, and although the base has remained flat, skis and snowboards are now manufactured with inherent base edge and side edge bevel angles. As a result, it is now necessary to maintain both base edge and side edge bevel angles when sharpening and polishing to ensure optimal ski and snowboard performance.

SUMMARY OF THE INVENTION

The present invention provides an apparatus for the sharpening and/or bevelling of either a ski or snowboard side edge or base edge, said apparatus comprising a guide for clamping a file or the like therein and adapted to be held by a hand of a person using the guide and moved lengthwise along an edge portion of a ski or snowboard while in contact with a surface thereof and which includes a variable angle adjustment mechanism to establish an almost unlimited number of selected angular orientations of said guide and the file in a plane transverse to said lengthwise direction when positioned at the side or base edge portion of the ski or snowboard and while in contact with the surface thereof. This unique apparatus is portable, inexpensive and easy to use and helps to minimize the fatigue and effort required to perform an accurate and consistent edge sharpening and bevelling job, especially on ski and snowboard equipment with inherent base edge and side edge bevel angles as described above.

In a preferred embodiment of the invention the variable angle adjustment mechanism includes a wheel rotatably mounted on an eccentric hub and positionable by a person using the guide in any one of a virtually unlimited number of selected positions to rollingly engage the surface of the ski or snowboard and to establish a selected angular orientation of said guide and the file in a plane transverse to said lengthwise direction when positioned at the side or base edge portion of the ski or snowboard thereby establishing a desired edge geometry or bevel angle. The variable angle adjustment mechanism is preferably integrated with a file clamping mechanism as more fully described hereafter.

BRIEF DESCRIPTION OF THE VIEWS OF DRAWINGS

In drawings which illustrate embodiments of the invention:

Figure 2:
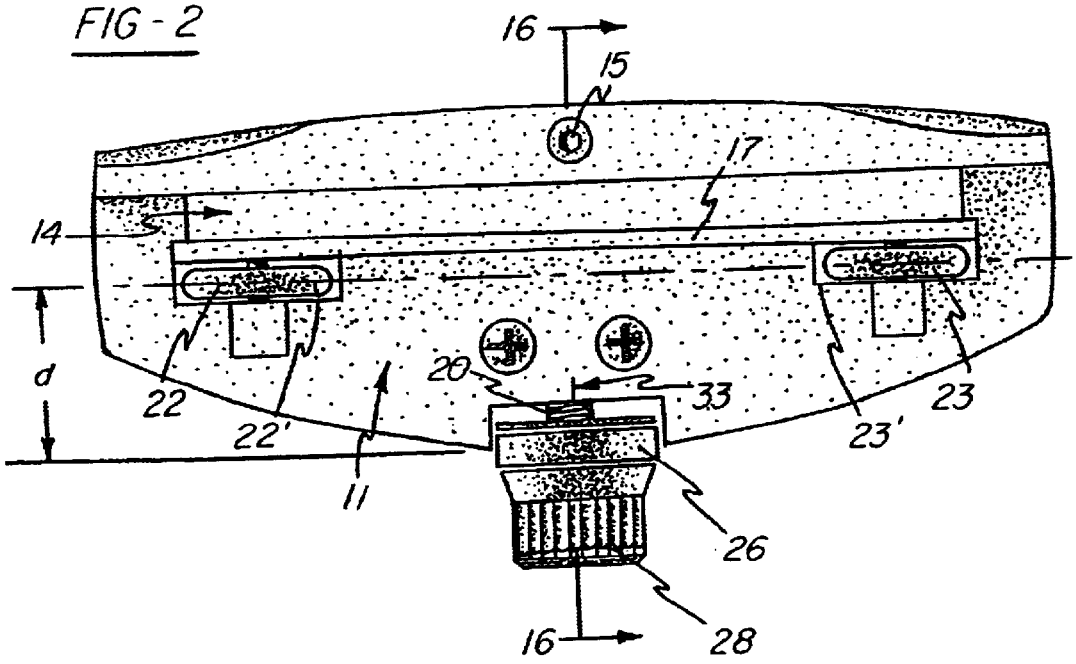
FIG. 2 is a side elevation view of the apparatus showing the variable angle adjustment and clamping mechanism.
Figure 13A:
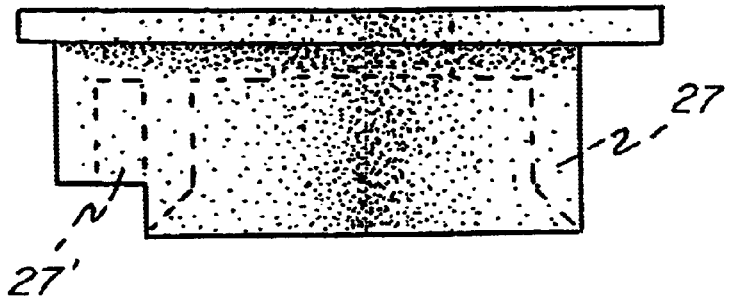
Figure 13B:
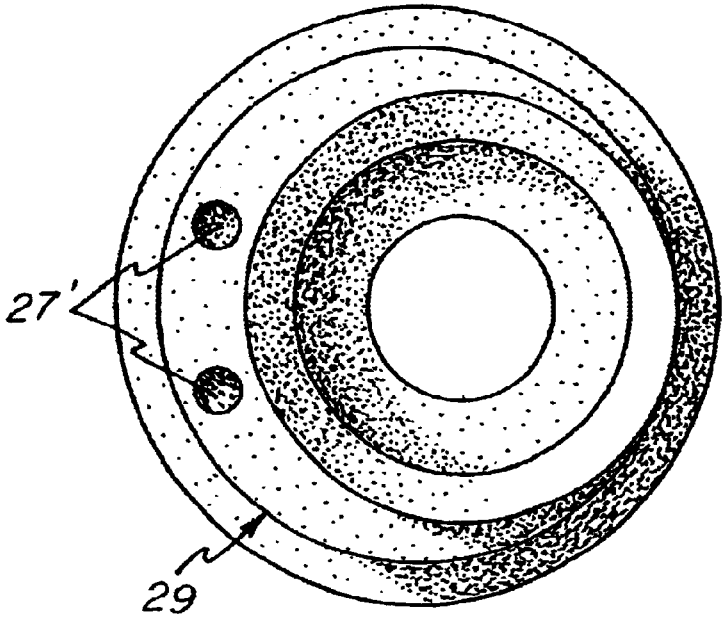
Figure 14A:
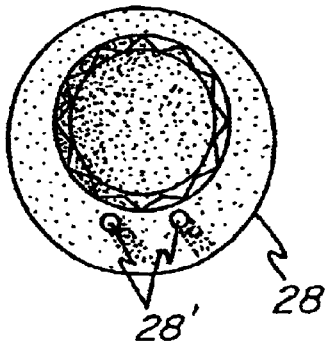
Figure 14B:
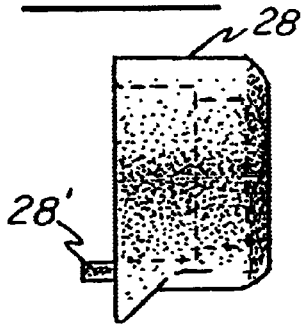
Figure 14C:
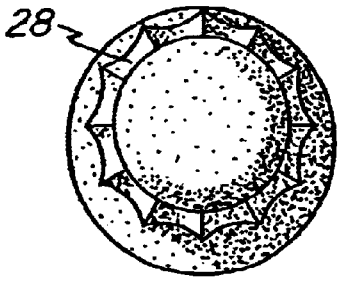
Figure 15A:
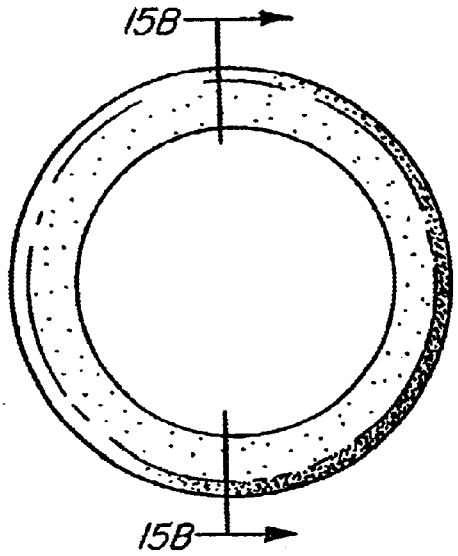
Figure 15B:
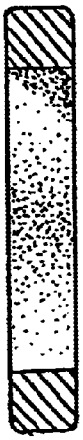
Figure 16:
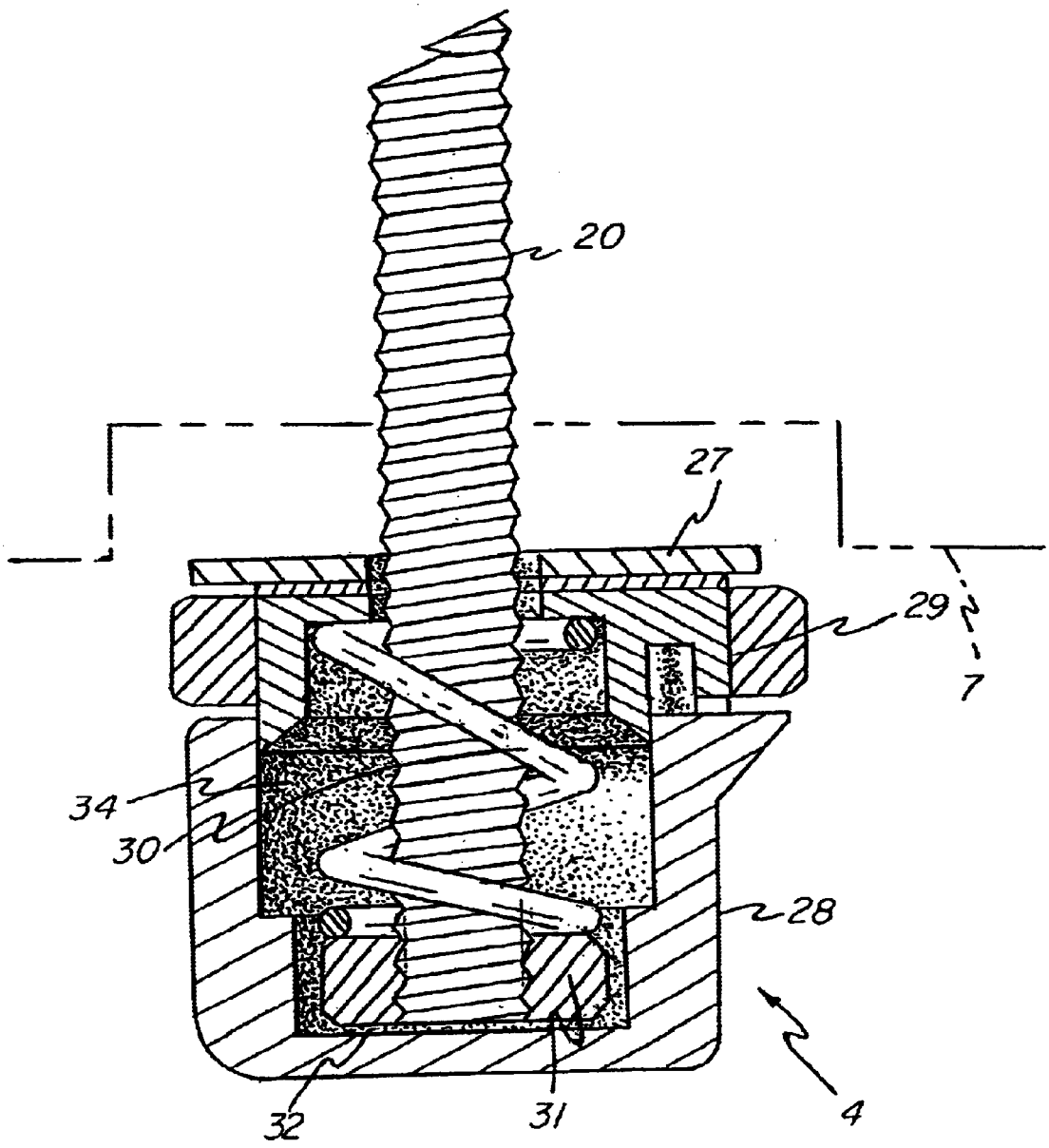
Figure 17:
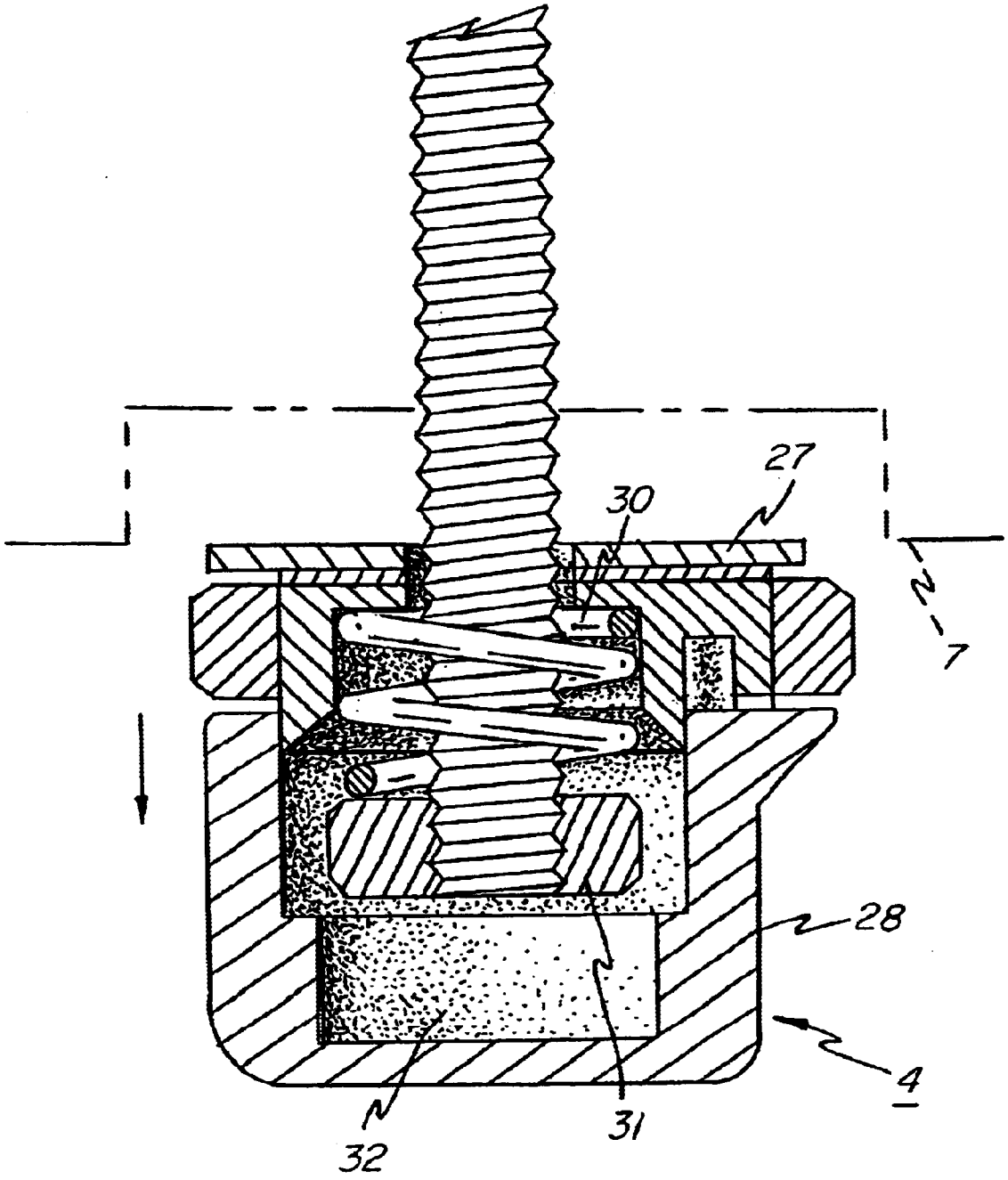

FIGS. 13A and B are side and bottom views respectively of the hub component of the variable angle adjustment and clamping mechanism;

FIGS. 14A, B and C are top, side and bottom views respectively of the knob component of the variable angle adjustment and clamping mechanism;

FIG. 15A is a top view of the rotatable wheel component of the variable angle adjustment and clamping mechanism and 15B is a cross section view taken along line 15B—15B of FIG. 15A;

FIG. 16 is a cross section view of the variable angle adjustment and clamping mechanism taken along line 16—16 of FIG. 2 illustrating the hex head of the bolt positioned in the countersunk hex depression portion of the knob component with the compression spring relaxed; and FIG. 17 is a cross section view of the variable angle adjustment and clamping mechanism similar to FIG. 16 but with the spring fully compressed and the hex head portion of the bolt positioned in the cylindrical cavity portion of the knob component.

DETAILED DESCRIPTION OF THE PREFERRED EMBODIMENT

Figure 1:
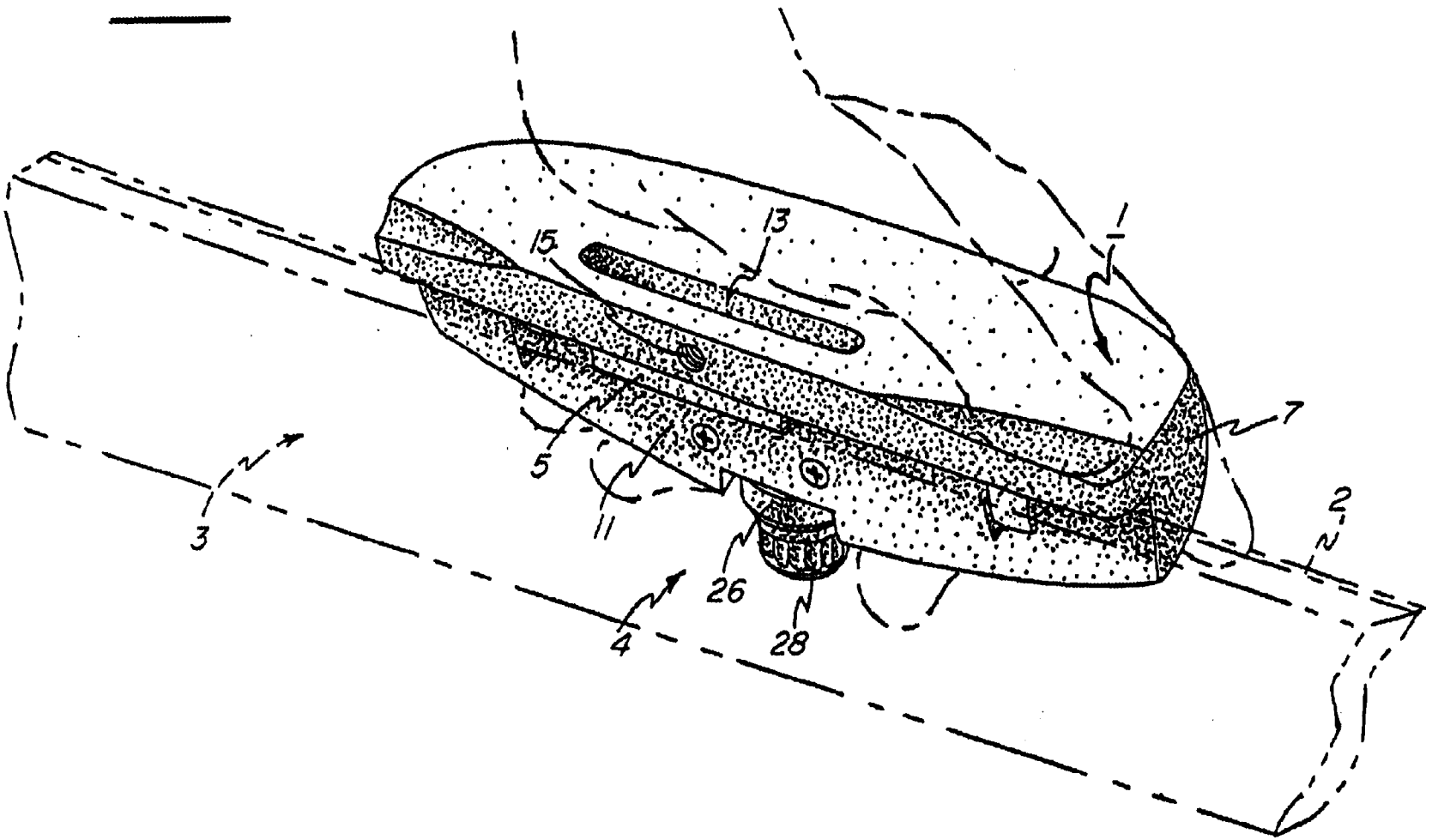
FIG. 1 is a perspective view illustrating the apparatus for sharpening/bevelling of ski or snowboard edges being used to sharpen and bevel the metal side edge of a ski or snowboard using a commercially available file.

Referring now to the drawings there is shown at FIG. 1 an apparatus for the sharpening and/or bevelling of either a ski or snowboard side edge or base edge. The apparatus comprises a guide 1 adapted to be held by the hand and moved lengthwise along a metal edge portion 2 of a ski or snowboard 3 while in contact with a surface thereof. The guide 1 includes a variable angle adjustment and clamping mechanism 4, the latter including suitable means for clamping the file 5 or the like in the guide 1. Additionally, the variable angle adjustment and clamping mechanism 4 includes means to angularly orient the guide and the file 5 clamped therein in a plane transverse to said lengthwise direction when positioned at the side edge portion 2 of the ski or snowboard to establish a desired side edge geometry or bevel angle. All of the above-noted features will now be described in some detail.

The expression "file" includes a variety of cutting/polishing implements which can be clamped in the guide 1 including rough (panzer) files, smooth (mill) files, x-coarse, coarse, fine and extra fine diamond whetstones, deburring stones etc. This allows the guide 1 to be used for a variety of operations including honing, deburring and polishing as well as rough and smooth filing.

The guide comprises a body or housing 7, typically of a sturdy plastics material, the rear and top faces 8, 9 of which are smoothly contoured to facilitate gripping the tool in the hand of the user and to provide an attractive appearance. As best seen in the end elevation views of FIGS. 6 and 7, the lower part of the frontal face 10 of the housing 7 is recessed or stepped inwardly to provide an inverted L-shape which is defined in part by a flat face plate 11 and a further wall 12 at right angles thereto. The upper portion of housing 7 is provided with an elongated vertical slot 13 therethrough, one wall of which is generally co-planar with the face plate 11. A horizontal slot 14 also extends through housing 7, the upper wall of the slot being co-planar with the further wall 12. Slots 13 and 14 are at right angles to one another and their purpose is to receive a file 5 in the course of base edge or side edge preparation as described hereafter.

Figure 3:
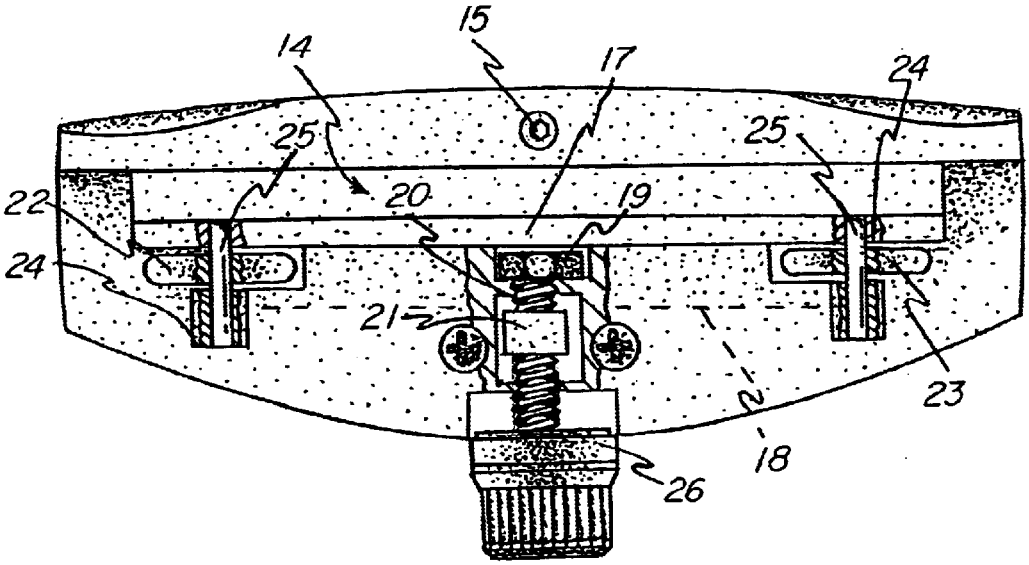
FIG. 3 is a side elevation view similar to FIG. 2 but illustrating the internal configuration of the guide.
Figure 10:
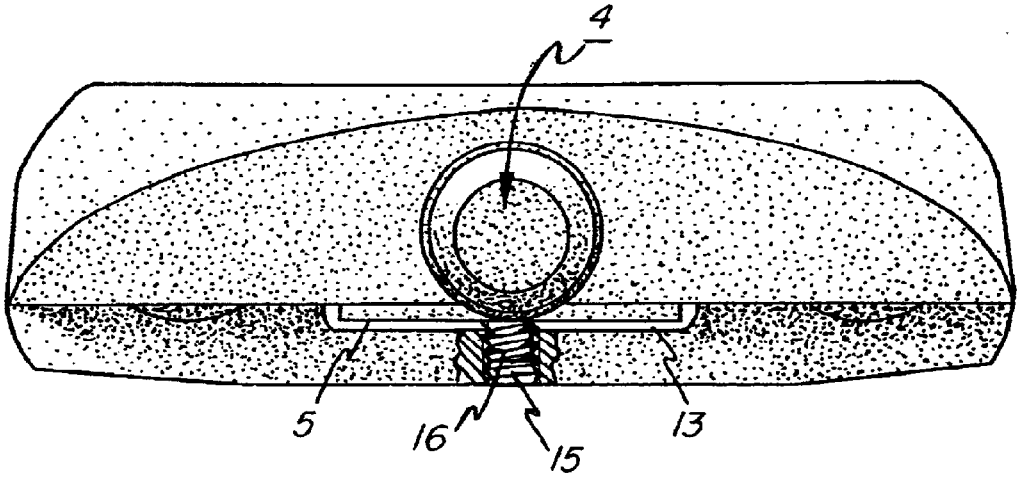
FIG. 10 is a bottom view similar to FIG. 9 but with a set screw clamping a file against the guide through the base edge slot.
Figure 12:
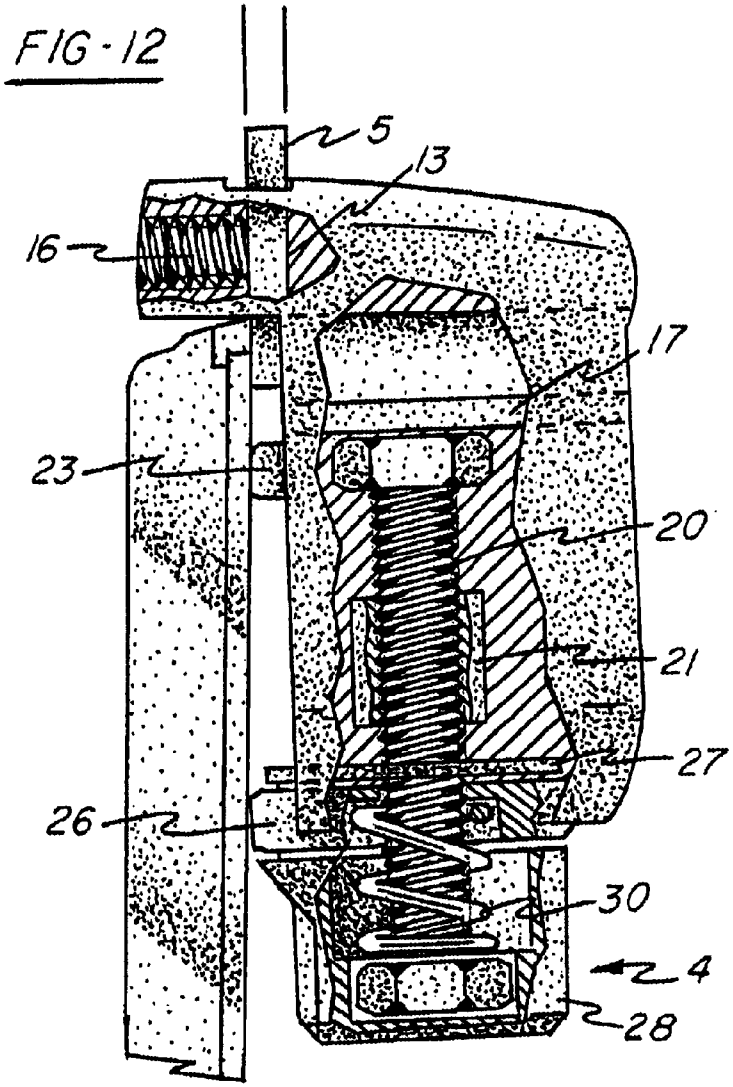
FIG. 12 is an end elevation view similar to FIG. 11 showing internal structures in phantom and illustrating the ability of the variable angle adjustment and clamping mechanism to establish a base edge bevel angle.
Figure 11:
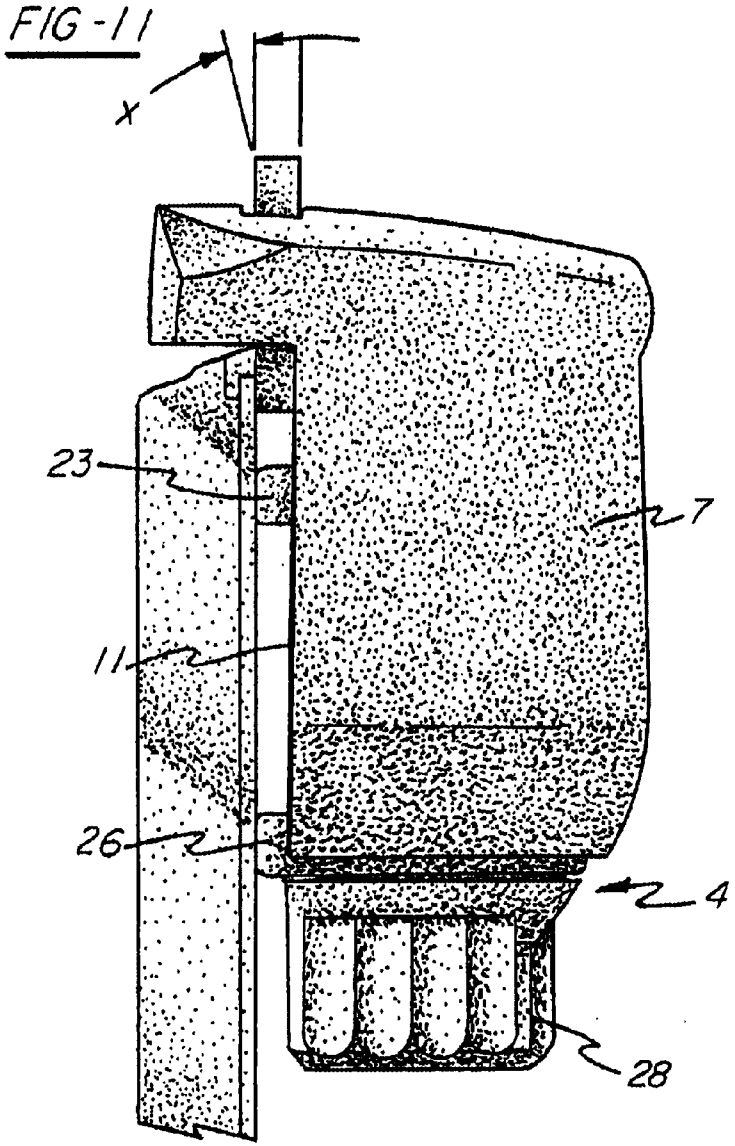
FIG. 11 is an end elevation view of the apparatus positioned for the sharpening and/or bevelling of a base edge of a ski or snowboard.

The housing portion adjacent slot 13 is provided with a threaded hole 15 through which a set screw 16 extends (FIG. 10). When the set screw 16 is tightened it is urged toward the opposing wall of the slot 13 thus enabling the file 5 to be securely clamped in slot 13 when required. In a similar manner, the transverse slot 14 is provided with an elongated clamp plate 17 parallel to the upper wall of the slot and which is co-extensive with slot 14. Clamp plate 17 is provided with a downwardly depending rigid web 18 (FIG. 3) at right angles thereto. The underside of clamp plate 17 abuts the end of a lock-nut 19 located in an opening in web 18 and disposed on the threaded end portion of a clamp screw 20 threaded through a brass insert 21 fixedly mounted in housing 7. Web 18 also carries two rollers 22, 23 that contact the ski/snowboard surfaces in use and help serve to angularly orient the guide and provide stability when sharpening and/or bevelling the side edge of a ski or snowboard as described hereafter. These rollers project through face plate 11 via corresponding slots 22' and 23' closely adjacent slot 14 which allow freedom of movement of clamp plate 17 and its web 18 to urge clamp plate 17 toward or away from the opposing wall of slot 14 as the clamp screw 20 is tightened or loosened. Web 18 also serves to non-rotatably captivate lock-nut 19 thus allowing the clamp plate 17 to be height-adjustable (actuated upward or downward as required by tightening or loosening the clamp screw 20) so that different file thicknesses can be accommodated in slot 14.

Reference will now be had to the rollers 22, 23 and variable angle adjustment mechanism 4 used to establish base edge and side edge bevel angles. The rollers 22, 23 are of a hard long wearing material such as a ceramic and each has a cylindrical hole 24 in its center through which a round steel rod 25 extends and acts as a hub. Rollers 22, 23 are mounted on and are positioned in slots extending through web 18 of the clamp plate 17 such that both protrude an equal amount beyond face plate 11 and in use the peripheral surfaces of both rollers bear against the base of a ski or snowboard to stabilize the guide 1.

The variable angle adjustment and clamping mechanism 4 employs a freely rotatable wheel 26, preferably made of the same ceramic material as the rollers 22, 23, the outside or periphery of which contacts the ski or snowboard base to establish, together with rollers 22, 23, the bevel angle of the guide 1. The diameter of the rotatable wheel 26 is selected in accordance with the dimensions of the guide, especially the selected distance "d" (FIG. 2) between a line extending through the points where the rollers 22, 23 can rollingly make contact with a ski or snowboard surface and the part of the perimeter of wheel 26 which, in use, rollingly contacts that same surface. The wheel 26 is disposed on the hub 27 and adjacent to knob 28. A bearing surface 29 on hub 27 (see FIGS. 13A, 13B, 16 and 17) provides an eccentric offset relative to the center of clamp screw 20 and allows the wheel 26 to rotate freely thereon. Compression spring 30 acts to bias the hex head 31 of clamp screw 20 into countersunk depression 32 allowing the entire mechanism 4 to control the clamping function. A knob 28 fits over the hub 27 and has projections 28' thereon which fit into corresponding holes 27' in the hub 27. The two projections 28' serve three purposes. First, they act as locators to align the knob 28 and hub 27 in the proper position relative to each other. Second, they prevent the knob and hub from rotating and changing alignment relative to each other. Third, the male projections 28' on the knob 'friction fit' into the corresponding cylindrical holes 27' in the hub (part tolerances are 'size on size') creating what may be referred to as a 'Mattel' boss, named after the toy company that pioneered the use of such closures. This 'friction fit' effectively overcomes the ability of the compression spring 30 to pry the knob and hub apart. Other means to keep the knob and hub together may be used, including a 'snap fit' flange and wedge shaped configuration around the internal diameters of both components where the parts contact each other to provide a mechanical locking mechanism; (the plastic flange of one part is forced to expand by a 'wedge' configuration around the diameter of the other part so when the parts are put together they 'snap' into position to prevent the compression spring from forcing the parts apart.) The knob and hub could also employ the use of commercially available threaded fasteners or thread-cutting screws to mechanically fasten the knob and hub together.

To effect file clamping, the knob is in the "home" position shown in FIG. 16 wherein the hex head 31 of the clamp screw 20 is located in depression 32. Rotation of the knob 28 causes the clamp screw 20 to rotate whereby to cause the clamp plate 17 to clamp a file in the guide. Once the file has been securely clamped, angular adjustment of the guide is effected as described below.

Figure 4:
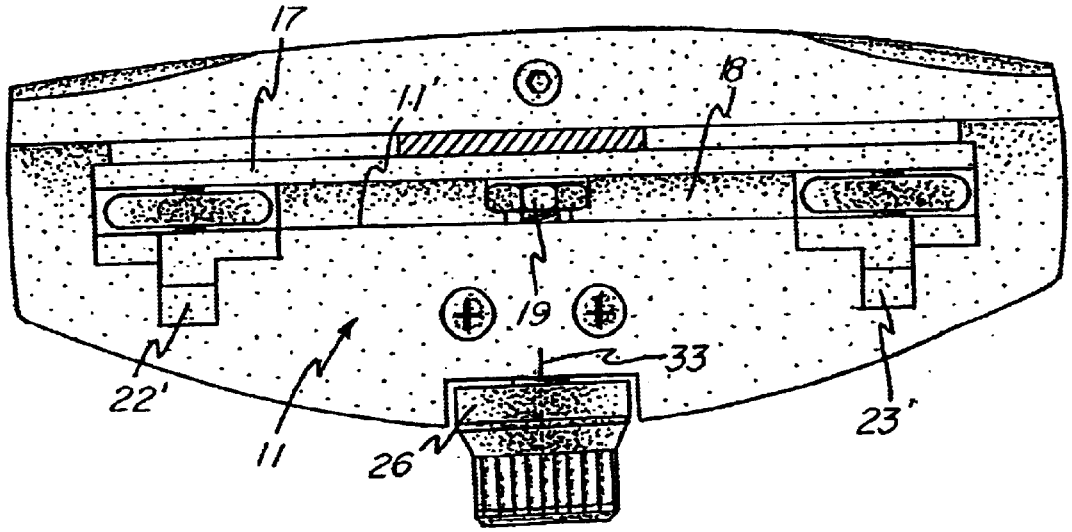
FIG. 4 is a further side elevation view of the apparatus showing the clamping of a file in the guide.
Figure 5:
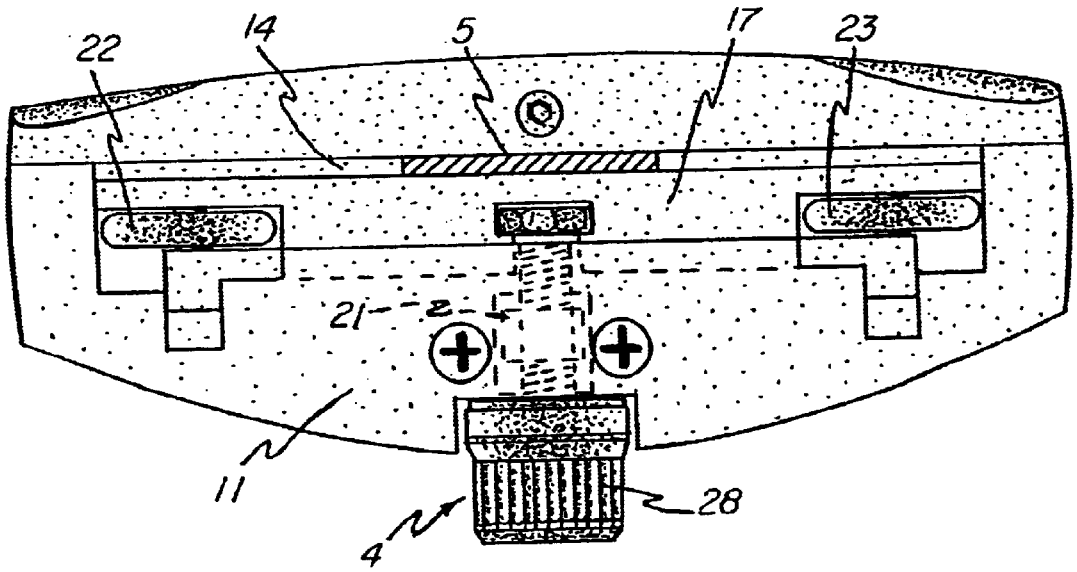
FIG. 5 is a further side elevation view similar to FIG. 3 but with the variable angle adjustment and clamping mechanism operating to effect clamping of a file.

Angular adjustment of the guide 1 is established following clamping of the file by first aligning a point on the outside diameter of the knob 28 with indicator 33 (FIGS. 2 and 4) on the face plate 11. The position of the periphery or outside diameter of the wheel 26 relative to the face plate 11 of guide 1 can then be adjusted by grasping and pulling the knob 28 away from housing 7 (a partial outline of which is seen in FIG. 17), thereby compressing spring 30 and causing hex head 31 to move into cylindrical cavity 34 within the knob 28 (FIG. 16) thus allowing the knob 28 together with hub 27 to be rotated clockwise or counterclockwise relative to the clamp screw 20 until the desired alignment has been found. As hub 27 is rotated, the position of the rotation axis of wheel 26 relative to the face plate 11 of the guide changes and the distance that the perimeter of wheel 26 projects beyond face plate 11 increases or decreases thus causing the guide to rotate around the above-noted line defined by the points of contact between rollers 22, 23 and the surface of the ski or snowboard, to provide the desired angular adjustment. The spring 30, following release of knob 28, then acts to bias knob 28 into the "home" position so that the hex head 31 of clamp screw 20 enters into countersunk depression 32 (FIG. 16) allowing the entire mechanism 4 to again adjust the clamping action. Turning the knob 28 also turns clamp screw 20 clockwise or counter-clockwise once a file 5 is clamped in the guide 1 (causing more or less compression of the file 5 by clamp plate 17 against the opposing wall of slot 14 in the housing of guide 1) and allows for micro adjustment between angles without the need to pull the knob outwardly since the amount of knob rotation needed here is small and flexure of the guide housing ensures that the file is securely held at all times. Hence, with the guide 1 in position for use as in FIG. 1 and with the wheel 26 and rollers 22, 23 contacting a surface of the ski or snowboard described hereafter, a desired angular orientation can be achieved to enable the desired edge bevel angle to be created. The freely rotatable wheel 26 and rollers 22, 23 assure smooth and easy movement of the entire guide in the lengthwise direction during use thereby reducing user fatigue, etc.

The degree increments obtainable are dependent on the degree of eccentricity of the bearing surface 29 of hub 27 on which wheel 26 is mounted, outside diameter of the wheel 26, distance "d" between the contact line defined by rollers 22, 23 and wheel 26, and position of the file 5 in the guide 1. One embodiment of the invention allows the countersunk depression 32 to captivate the hex head 31 of clamp screw 20 in any one of twelve positions, allowing for six degree side edge angle adjustment (i.e. when the knob is rotated 360 degrees, angle alignment positions include 0, 1, 2, 3, 4, 5, 6, 5, 4, 3, 2, 1 degrees).

Figure 7:
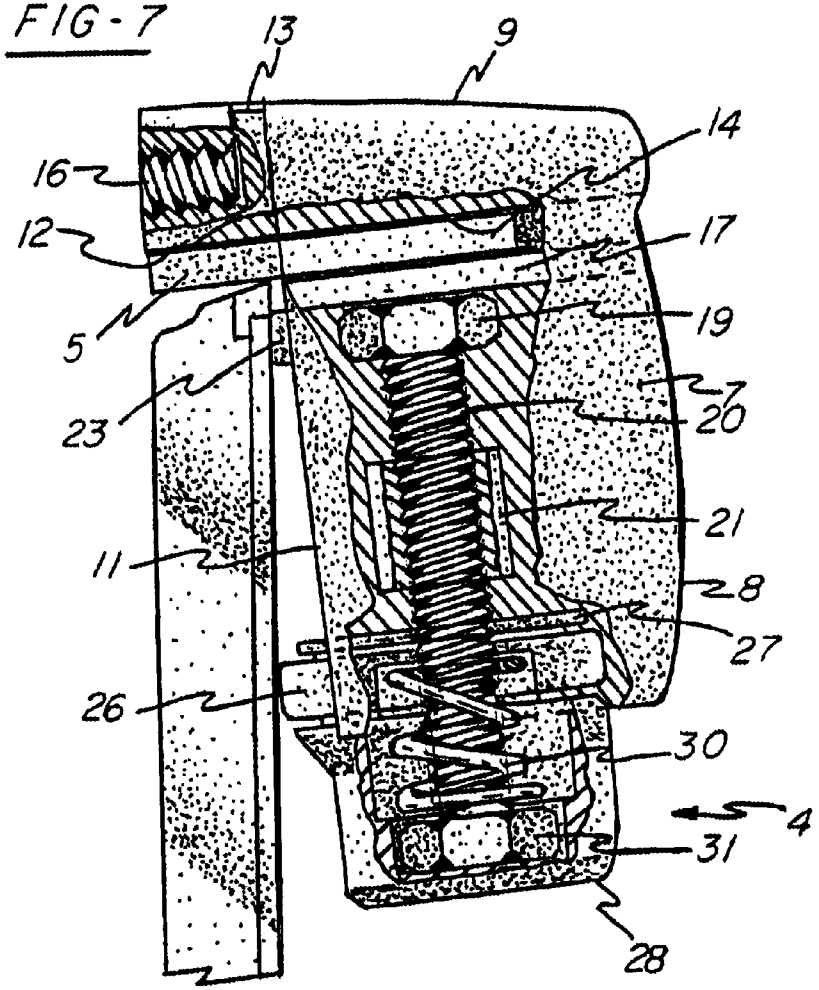
FIG. 7 is an end elevation view similar to FIG. 6 showing internal structures in phantom and illustrating the ability of the variable angle adjustment and clamping mechanism to establish a side edge bevel angle.
Figure 6:
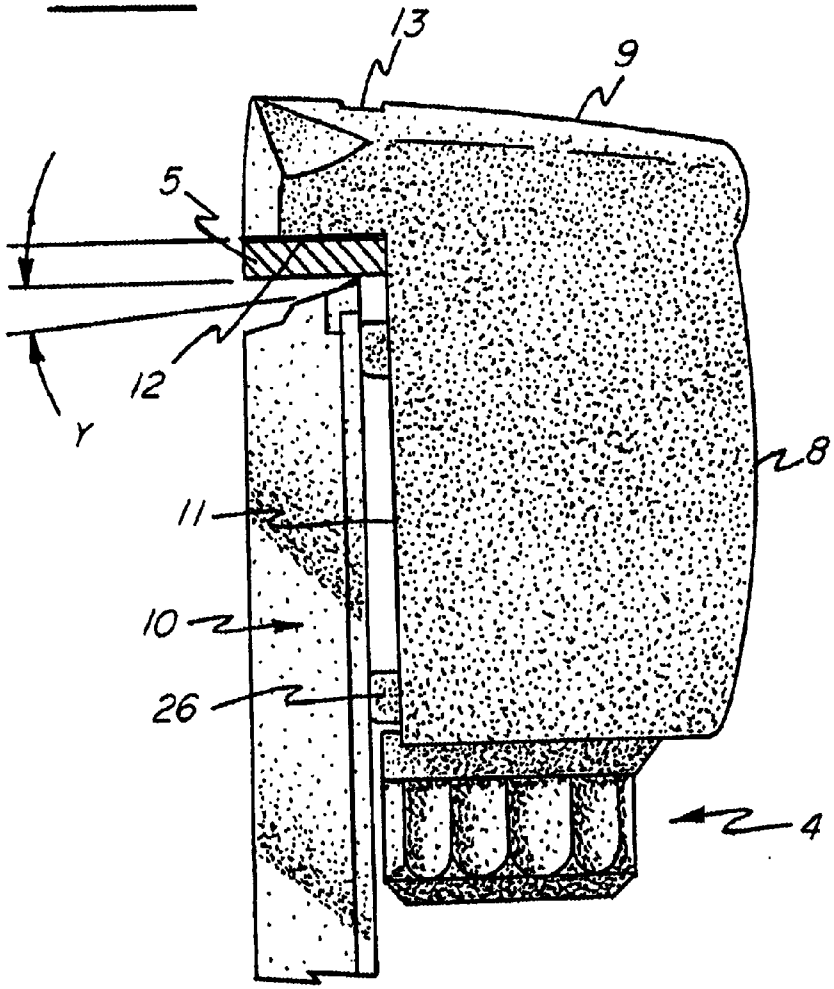
FIG. 6 is an end elevation view of the apparatus positioned for the sharpening and/or bevelling of a side edge of a ski or snowboard.
Figure 8:
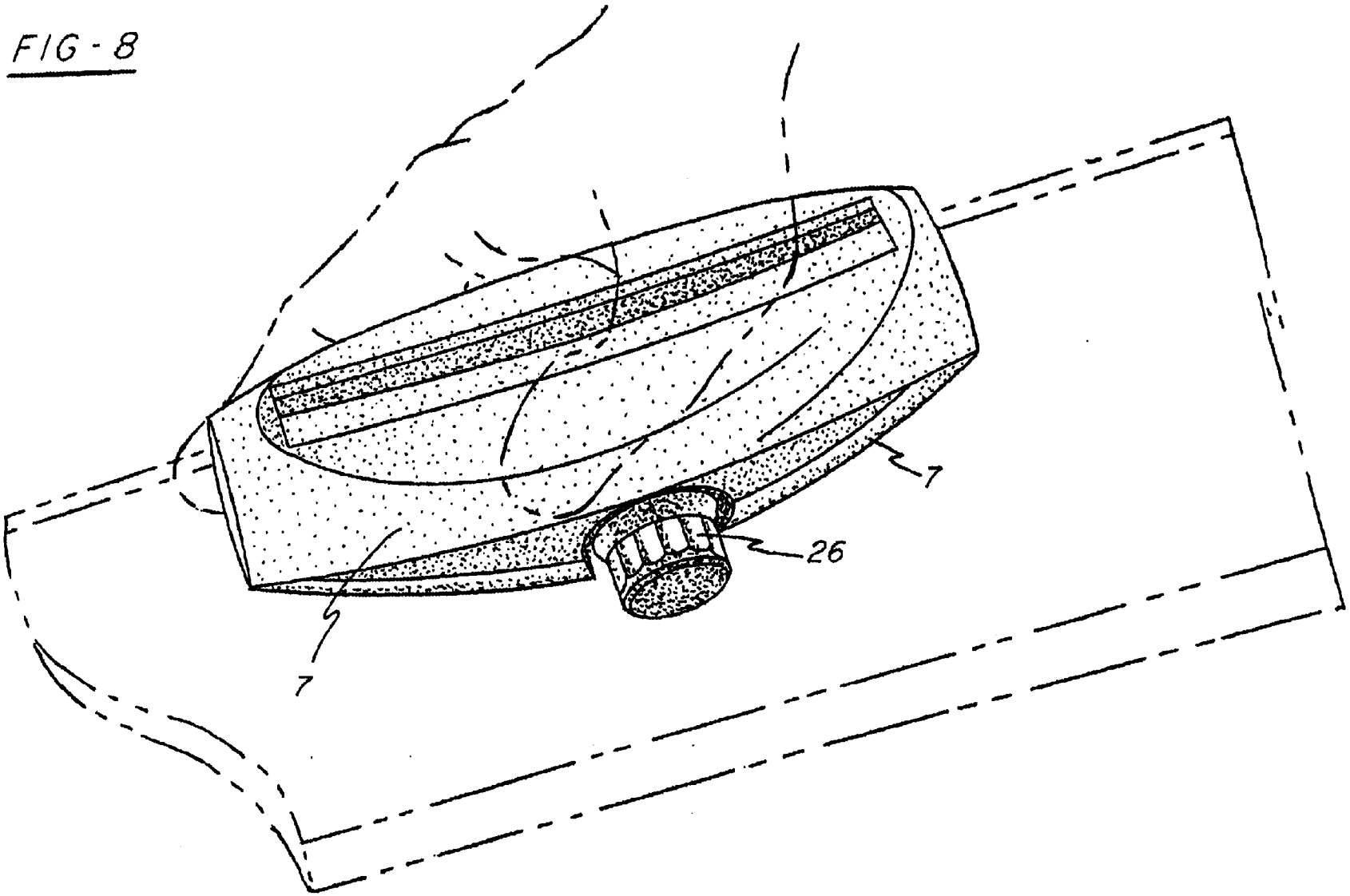
FIG. 8 is a perspective view from below illustrating the apparatus for sharpening/bevelling of ski or snowboard edges being used to sharpen and bevel the base edge of a ski or snowboard.
Figure 9:
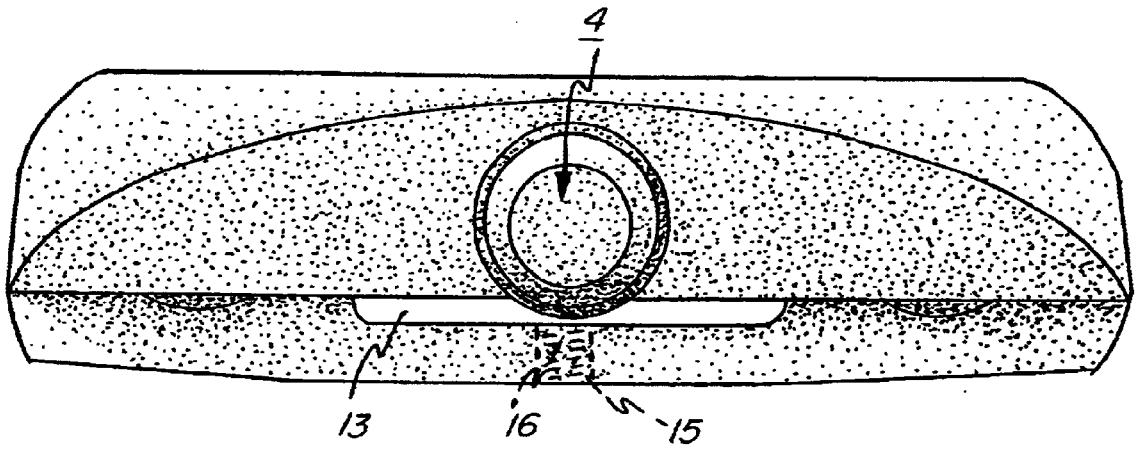
FIG. 9 is a bottom view of the apparatus and variable adjustment and clamping mechanism.

FIGS. 8, 10, 11 and 12 illustrate base edge preparation. Here the file 5 is inserted through slot 13 of the guide 1 and secured by set screw 16. The variable angle adjustment and clamping mechanism 4 including clamp screw 20 are turned so the lower edge portion of clamp plate 17 makes contact with edge portion 11' of face plate 11 to ensure the mechanism 4 is in the correct "home" position to achieve a consistent base edge bevel angle. By aligning the correct point on the knob 28 with indicator 33 on the face plate 11, the desired base edge bevel angle "X", (shown in exaggerated fashion in FIG. 11) can be achieved. Side edge preparation is illustrated in FIGS. 1, 6 and 7. In this case, the file 5 is inserted through slot 14 of guide 1 and secured by clamp plate 17. By aligning the correct point on the knob 28 with indicator 33 on the face plate 11, the desired side edge bevel angle "Y", (shown in exaggerated fashion in FIG. 6) can be achieved.

It should be realized that the entire side edge of the ski or snowboard i.e. both the metal edge and the remaining exposed side edge material also referred to as the "edge offset" can be bevelled with the use of guide 1. To achieve this, the eccentric offset of the wheel 26 is maximized (see FIG. 7). This provides a relatively large side edge bevel angle "Y" and enables the edge offset material to be cut or bevelled alone or in concert with the metal side edge. A short section of "Pansar" file can be used to advantage here.

In general, as regards the variable angle adjustment and clamping mechanism 4 and depending on the eccentric offset defined by bearing surface 29 on the hub 27 and the diameter of the wheel 26, the same wheel 26 position is able to produce two different bevel angles (one side edge bevel angle and one base edge bevel angle). Also in the illustrated embodiment, the wheel 26 position used to produce a certain side edge bevel angle can produce exactly ⅔ that bevel angle when used to bevel the base edge, (e.g. the wheel position used to create a 3 degree side edge bevel can also be used to create a 2 degree base edge bevel). This is but one illustration of the flexibility and versatility of the tool.

A preferred embodiment of the invention has been described by way of example. Those skilled in the art will realize that various modifications and changes may be made while remaining within the spirit and scope of the invention. Hence the invention is not to be limited to the embodiment as described but, rather, the invention encompasses the fill range of equivalencies as defined by the appended claims.

What is claimed is:

1. An apparatus for the sharpening and/or bevelling of either a ski or a snowboard side edge or base edge, said apparatus comprising a guide adapted to be held by a user and moved in a lengthwise direction along an edge portion of a ski or snowboard while in contact with a surface thereof, said guide including a device for securing a file thereto such that in use a desired portion of the file can make contact with the edge portion of the ski or snowboard thus effecting edge sharpening or bevelling, said guide including a guide body having an adjustment mechanism to angularly orient the guide body and the file in a plane transverse to said lengthwise direction when positioned at the side or base edge of the ski or snowboard to establish a desired edge geometry or bevel angle, said guide body including a face portion which is positioned adjacent a surface of the ski or snowboard when in use, said adjustment mechanism including a freely rotatable wheel, a peripheral part of which wheel projects outwardly of the guide face portion to rollingly engage the ski or snowboard surface when in use, said wheel being adjustably mounted to project outwardly from said guide face portion by selected distances to establish selected angular orientations of said guide body and the file in said transverse plane relative to the ski or snowboard.

2. The apparatus according to claim 1 wherein said rotatable wheel is mounted on a hub having an eccentrically arranged bearing surface thereon on which said wheel is rotatably mounted, said hub being angularly adjustable so as to cause the position of the rotation axis of said wheel to change to increase or decrease the distance that the peripheral part of the wheel projects outwardly of said face portion thereby to provide the desired angular orientation of the guide body.

3. The apparatus according to claim 2 wherein said guide body further includes a spaced pair of rollers adapted to contact the surface of the ski or snowboard at spaced points of contact during use, said pair of rollers being spaced a selected distance from said wheel so that when the position of the rotation axis of said wheel is changed during use when in contact with said surface said guide body rotates around a line defined by said spaced contact points of said rollers to provide the desired angular orientation of the guide body.

4. The apparatus according to claim 3 wherein said device for securing the file includes a clamp for securing the file in said guide body during use.

5. The apparatus according to claim 4 including a rotatable mechanism for releasing or tightening said clamp.

6. The apparatus according to claim 5 including a structure for rotating said hub to effect the angular adjustment thereof, said structure also being operably connectable to said rotatable mechanism for releasing or tightening said clamp such that said hub can be rotated either independently of or simultaneously with said rotatable mechanism.

7. The apparatus according to claim 6 wherein said rotatable mechanism comprises a clamping screw operatively connected to said clamp.

8. The apparatus according to claim 7 wherein said structure for rotating said hub includes a knob connected for rotation with the hub, said clamping screw having a head portion disposed within the hub-knob combination, the latter being free to move axially relative to the clamping screw between first and second positions so as to engage or disengage the screw head portion therefrom, whereby in the first position said hub is rotatable together with said clamping screw and in the second position said hub can be rotated independently of said clamping screw.

9. The apparatus according to claim 8 further including a spring for biasing said screw head relative to the hub-knob combination into the first position, and wherein a manual force applied to said knob serves to compress said spring and move the hub-knob combination into said second position whereby to allow said hub to be rotated independently of said clamping screw.

* * * * *

UNITED STATES PATENT AND TRADEMARK OFFICE

CERTIFICATE OF CORRECTION

PATENT NO. : 6,634,256 B2
DATED : October 21, 2003
INVENTOR(S) : Richard K. Weissenborn It is certified that error appears in the above-identified patent and that said Letters Patent is hereby corrected as shown below:

Column 1,
Lines 11-13, "effectively filed Jul. 21, 2000, now U.S. Pat. No. 6,386,068, which is a 371 of PCT/CT98/00320 filed Apr. 9. 1998." should read -- effectively filed Jan. 21, 2000, now U.S. Pat. No. 6,386,068, which is a 371 of PCT/CA98/00320 filed Apr. 9, 1998. --;

Column 5,
Line 8, "(Fig.16) thus allowing" should read -- (Fig. 17) thus allowing --;
Lines 24-25, "slot 14 in the" should read -- slot 17 in the --;

Column 6,
Line 24, "the fill range" should read -- the full range --.

Signed and Sealed this

Sixteenth Day of March, 2004

JON W. DUDAS
*Acting Director of the United States Patent and Trademark Office*